US009354543B2

(12) United States Patent
Sato

(10) Patent No.: US 9,354,543 B2
(45) Date of Patent: May 31, 2016

(54) DEVELOPING DEVICE AND IMAGE FORMING DEVICE HAVING THE SAME

(71) Applicant: Shougo Sato, Seto (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/204,558

(22) Filed: Mar. 11, 2014

(65) Prior Publication Data

US 2014/0193174 A1 Jul. 10, 2014

Related U.S. Application Data

(63) Continuation of application No. 14/034,820, filed on Sep. 24, 2013, now Pat. No. 8,774,686, which is a continuation of application No. 13/433,469, filed on Mar. 29, 2012, now Pat. No. 8,565,653, which is a (Continued)

(30) Foreign Application Priority Data

Apr. 30, 2008 (JP) ..... 2008-117979

(51) Int. Cl.
*G03G 15/08* (2006.01)
*G03G 21/16* (2006.01)

(52) U.S. Cl.
CPC ..... *G03G 15/0808* (2013.01); *G03G 15/0867* (2013.01); *G03G 15/0896* (2013.01); *G03G 21/1676* (2013.01); *G03G 2215/085* (2013.01)

(58) Field of Classification Search
CPC ..... G03G 2215/085; G03G 15/0896
USPC ..... 399/119, 263, 281
See application file for complete search history.

(56) References Cited

U.S. PATENT DOCUMENTS 5,384,628 A 1/1995 Takami et al.
6,343,201 B1 1/2002 Wada et al.

(Continued)

FOREIGN PATENT DOCUMENTS

JP H06-208297 A 7/1994
JP H08-95360 A 4/1996

(Continued)

OTHER PUBLICATIONS

JP Office Action dated Feb. 16, 2010, JP Appln. 2008-117979, English translation.

(Continued)

*Primary Examiner* — Walter L Lindsay, Jr.
*Assistant Examiner* — Ruth Labombard
(74) *Attorney, Agent, or Firm* — Banner & Witcoff, Ltd.

(57) ABSTRACT

An image forming device includes a plurality of cartridges each including a developing member, a supply member, a developing agent container, and a conveying member. The container is disposed below the developing member and the supply member and has an inner surface defining an internal space. The container has an opening having an upper edge and a lower edge. The conveying member is rotatably disposed in the internal space and is configured to convey the developing agent upward. The container includes a first wall portion extending from the lower edge in a downstream direction with respect to a rotational direction of the conveying member and includes a second wall portion extending from the upper edge in an upstream direction with respect to the rotational direction. The conveying member is in simultaneous sliding contact with both the upper and lower edges to convey the developing agent onto the first wall portion.

8 Claims, 8 Drawing Sheets

Related U.S. Application Data continuation of application No. 13/204,794, filed on Aug. 8, 2011, now Pat. No. 8,165,509, which is a continuation of application No. 12/412,718, filed on Mar. 27, 2009, now Pat. No. 8,005,404.

(56) References Cited

U.S. PATENT DOCUMENTS

| | | | | |
|---|---|---|---|---|
| 6,385,422 | B1 | 5/2002 | Ishiguro et al. | |
| 6,456,810 | B1 * | 9/2002 | Deguchi et al. | 399/254 |
| 6,721,527 | B2 | 4/2004 | Kanari et al. | |
| 6,907,215 | B2 | 6/2005 | Yasukawa et al. | |
| 2002/0085860 | A1 | 7/2002 | Itaya | |
| 2003/0113139 | A1 * | 6/2003 | Yasukawa et al. | 399/281 |
| 2007/0077087 | A1 * | 4/2007 | Okabe et al. | 399/111 |

FOREIGN PATENT DOCUMENTS

| | | | |
|---|---|---|---|
| JP | 2003-029532 | A | 1/2003 |
| JP | 2003-173084 | A | 6/2003 |
| JP | 2005-173012 | A | 6/2005 |

OTHER PUBLICATIONS

JP Office Action dated Oct. 26, 2010, JP Appln. 2010-151810, English translation.

CN Office Action dated Jan. 31, 2011, JP Appln. 200910136999.1, English translation.

CN Office Action dated Aug. 3, 2011, corresponding Application No. 200910136999.1; English Translation.

CN Office Action dated Feb. 13, 2012, corresponding Application No. 200910136999.1; English Translation.

* cited by examiner

DEVELOPING DEVICE AND IMAGE FORMING DEVICE HAVING THE SAME

CROSS REFERENCE TO RELATED APPLICATION

This application is a continuation of prior application Ser. No. 14/034,820 filed Sep. 24, 2013, which is a continuation of prior application Ser. No. 13/433,469 filed Mar. 29, 2012, which is a continuation of prior application Ser. No. 13/204,794 filed Aug. 8, 2011 (now U.S. Pat. No. 8,165,509), which is a continuation of prior application Ser. No. 12/412,718 filed Mar. 27, 2009 (now U.S. Pat. No. 8,005,404) which claims priority from Japanese Patent Application No. 2008-117979 filed Apr. 30, 2008, entire contents of which are incorporated herein by reference.

TECHNICAL FIELD

The present invention relates to a developing device and an image forming device provided with the developing device.

BACKGROUND

A tandem type image forming device is known in this field in which a plurality of photosensitive drums is arrayed in line in a horizontal direction. Laid-open Japanese Patent Application publication No. 2003-29532 discloses such image forming device provided with a toner container in which a toner chamber containing a toner as a developing agent is disposed below a photosensitive drum.

In such a conventional image forming device, stabilized toner supply to the photosensitive drum may be difficult to achieve, since the toner in the toner chamber must be conveyed upward against gravity of the toner. According to the device described in JP 2003-29532 publication, a toner agitator scoops the toner, and the scooped toner is accumulated on a toner accumulation plate provided at an upper portion of the toner container. Then the accumulated toner is supplied to a toner supply roller, and is then supplied to the photosensitive drum through a developing roller.

However, the toner agitator is out of contact from an inner surface of the toner chamber. Therefore, the toner carried on the toner agitator may be dropped out of the agitator and fallen into the toner chamber through a gap between the toner agitator and the inner surface. In other words, desirable delivery of the toner from the lower portion (toner chamber) to the upper portion (toner accumulation plate) cannot be performed.

SUMMARY

In view of the foregoing, it is an object of the present invention to provide a developing device capable of realizing sufficient delivery of the toners in the toner container from a lower portion to an upper portion, and to provide an image forming device provided with such developing device.

In order to attain the above and other objects, the present invention provides an image forming device including a casing, a support frame configured to be drawn from the casing, and a plurality of cartridges configured to be detachably supported by the support frame. Each of the cartridges includes a developing member, a supply member, a developing agent container, and a conveying member. The developing member has an outer surface configured to carry a developing agent. The supply member is configured to supply the developing agent to the outer surface. The developing agent container is disposed below the developing member and the supply member and has an inner surface defining an internal space for accommodating the developing agent. The developing agent container is formed with an opening having an upper edge and a lower edge. The conveying member is rotatably disposed in the internal space and is configured to convey the developing agent upward. The developing agent container includes a first wall portion extending from the lower edge in a downstream direction with respect to a rotational direction of the conveying member and also includes a second wall portion extending from the upper edge in an upstream direction with respect to the rotational direction. The conveying member is configured to be in simultaneous sliding contact with both the lower edge and the upper edge to convey the developing agent onto the first wall portion.

BRIEF DESCRIPTION OF THE DRAWINGS

In the drawings;

FIG. 4(*b*) is a front view of the toner agitator;

DETAILED DESCRIPTION

An image forming device provided with a developing device according to an embodiment of the present invention will be described with reference to FIGS. 1 through 6. Throughout the specification, the terms "upward", "downward", "upper", "lower", "above", "below", "beneath", "right", "left", "front", "rear" and the like will be used assuming that the image forming device is disposed in an orientation in which it is intended to be used. More specifically, in FIG. 1 a left side and a right side are a front side and a rear side, respectively.

Figure 1:
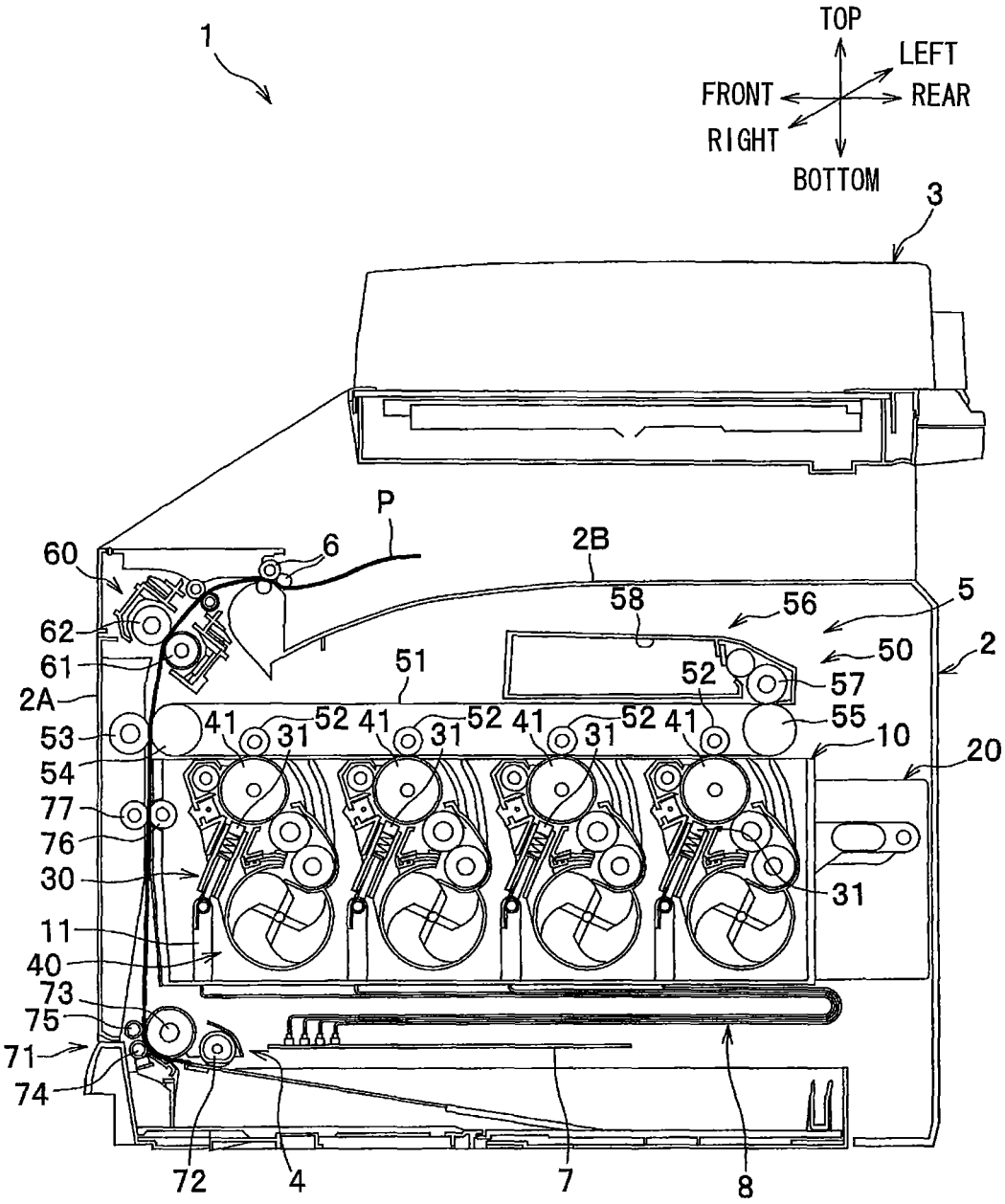
FIG. 1 is a cross-sectional view of a color multifunction device embodying an image forming device according to an embodiment of the present invention.

The image forming device 1 is a color multifunction device functioning selectively as a printer, a copying machine, and a scanner. As shown in FIG. 1, the multifunction device 1 has a generally box shaped casing 2, and generally includes a flat bed scanner 3 disposed above the casing 2, a sheet supplying mechanism 4 for supplying a sheet P as a recording medium, an image forming unit 5 for forming an image on the supplied sheet P, and a discharge roller 6 for discharging the sheet P on which an image has been formed.

A front cover 2A is provided at the front side of the casing 2. The front cover 2A has a lower portion pivotally connected to the casing 2 so as to open or close the front cover 2A in frontward/rearward direction. A discharge tray 2B is provided at an upper portion of the casing 2 for receiving and holding sheets P discharged from the casing 2 after printing. In the casing 2, a support frame 10 is provided for detachably supporting developing devices 40 described later, and further, a side frame 20 is fixed to the casing 2 for movably supporting the support frame 10 in such a manner that the support frame 10 can be drawn from the casing 2 through a front open end after the front cover 2A is opened.

The flat bed scanner 33 is provided by a conventional image reading device. An image data can be produced by reading an image on an original upon irradiating a light onto the imaging surface of the original.

The sheet supplying mechanism 4 generally includes a sheet cassette 71, a separation roller 72, sheet supply rollers 73-75, and sheet delivery rollers 76, 77. The sheet cassette 71 is detachably disposed at a lower portion of the casing 2 for accommodating therein a stack of sheets P. The separation roller 72 is provided at an upper front side of the sheet cassette 71 for separating an uppermost sheet from the remaining sheet stack. Then, each sheet is directed upward by the sheet supply rollers 73-75, and is then fed to the image forming unit 5 by way of the delivery rollers 76, 77.

The image-forming unit 5 includes four LED units 30, four developing devices 40 each including a photosensitive drum 41, a transfer unit 50, and a fixing unit 60. Each LED unit 30 is supported to the support frame 10 through a support arm 11. The LED unit 30 includes an LED head 31 positioned immediately below the photosensitive drum 41. A control board 7 is provided below the support frame 10 for transmitting signals indicative of image data to the LED head 31 through a cable 8 so as to emit light from the LED head 31, whereupon the photosensitive drum 41 is exposed to light. The LED head 31 is pivotally movably supported to the support arm 11 so as to provide a vertical orientation when the developing device 40 is removed from the support frame 10 as shown in FIG. 2.

Figure 2:
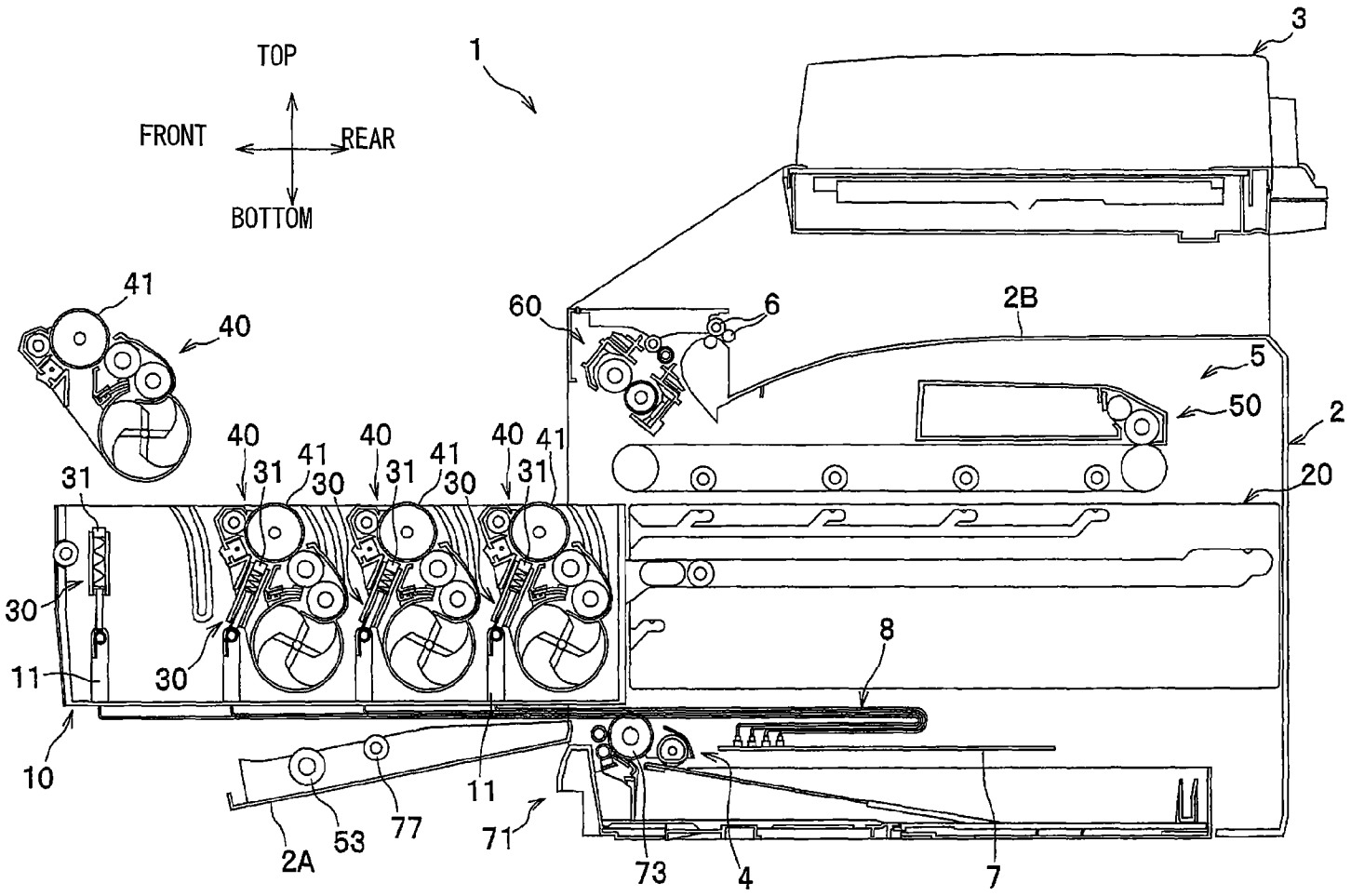
FIG. 2 is a cross-sectional view of the color multifunction device according to the embodiment in which a developing device are detaching from a main frame.

The developing devices 40 are detachably positioned in the support frame 10 and between the sheet cassette 71 and the discharge tray 2B, and are arrayed in line in the frontward/rearward as shown in FIG. 2. Details of the cartridge 40 will be described later.

The transfer unit 50 is positioned above the array of the developing device 40, and generally includes an intermediate transfer belt 51, four primary transfer rollers 52, a secondary primary roller 53, a drive roller 54, a follower roller 55, and a cleaning unit 56. The intermediate transfer belt 51 is in the form of an endless belt mounted under tension over the drive roller 54 and the follower roller 55 spaced away from the drive roller 54 in the frontward/rearward direction. Each of the photosensitive drums 41 is disposed below the intermediate transfer belt 51. The secondary transfer roller 53 is supported to the front cover 2A and is positioned at a front side of the intermediate transfer belt 51 so as to nip the belt 51 in cooperation with the drive roller 54.

Each of the primary transfer rollers 52 is in contact with an inner peripheral surface of the belt 51 and in alignment with each of the photosensitive drums 41 so as to nip the belt 51 therebetween. Transfer bias will be applied to the primary and secondary transfer rollers 51 and 52 during image transfer by way of a constant current control.

The cleaning unit 56 is disposed immediately above a rear half portion of the intermediate transfer belt 51, and includes a cleaning roller 57 and a toner accumulator 58. The cleaning roller 57 is adapted for removing residual toners deposited on the intermediate transfer belt 51, and the toner accumulator 58 is adapted for receiving toner removed from the belt 51.

The fixing unit 60 is provided at a position above the secondary transfer roller 53 and the drive roller 54, and includes a heat roller 61 and a pressure roller 62 in opposition thereto.

Next, the developing device 40 will be described in detail. In the depicted embodiment, four developing devices 40 for black, cyan, magenta and yellow are provided in association with four LED units 30. In the following description, the terms "front", "rear", "up", "down" and any words indicating direction are used as if the developing device 40 is assembled to the casing 2. Further, construction of each developing device 40 is identical to each other.

The developing device 40 has a cartridge case 40A in which the photosensitive drum 41, a charger 42, a developing roller 43 (developing member), a toner supply roller 44, a regulation blade 45, and an agitator 46 (developing agent conveying member) are provided. The cartridge case 40A includes a developing chamber section 47 and a toner container section 48.

The photosensitive drum 41 includes a metallic drum body grounded, and an electrically chargeable photosensitive layer formed over an outer peripheral surface of the drum body. The charger 42 is disposed in front of and in direct confrontation with the photosensitive drum 41, but is spaced away by a prescribed distance therefrom. The charger 42 is adapted for charging an outer peripheral surface of the photosensitive drum 41 with a substantially uniform polarity.

The developing roller 43 is positioned in the developing chamber section 47 at a position immediately below the photosensitive drum 41 and in contact therewith. The developing roller 43 is adapted for bearing toner T on its outer peripheral surface. The toner supply roller 44 is positioned in the developing chamber section 47 at a position immediately below the developing roller 43 and in contact therewith. The toner supply roller 44 is adapted to supply toner T to the developing roller 43 upon rotation of the toner supply roller 44, and includes a core shaft and a sponge layer formed thereover.

The regulation blade 45 is in sliding contact with the developing roller 43 for regulating a thickness of a toner layer formed on the developing roller 44. The blade 38 has a base end portion fixed to the cartridge case 40A, and a free end portion (contact portion) made from an elastic material such as rubber and contacting the developing roller 43.

Figure 4A:
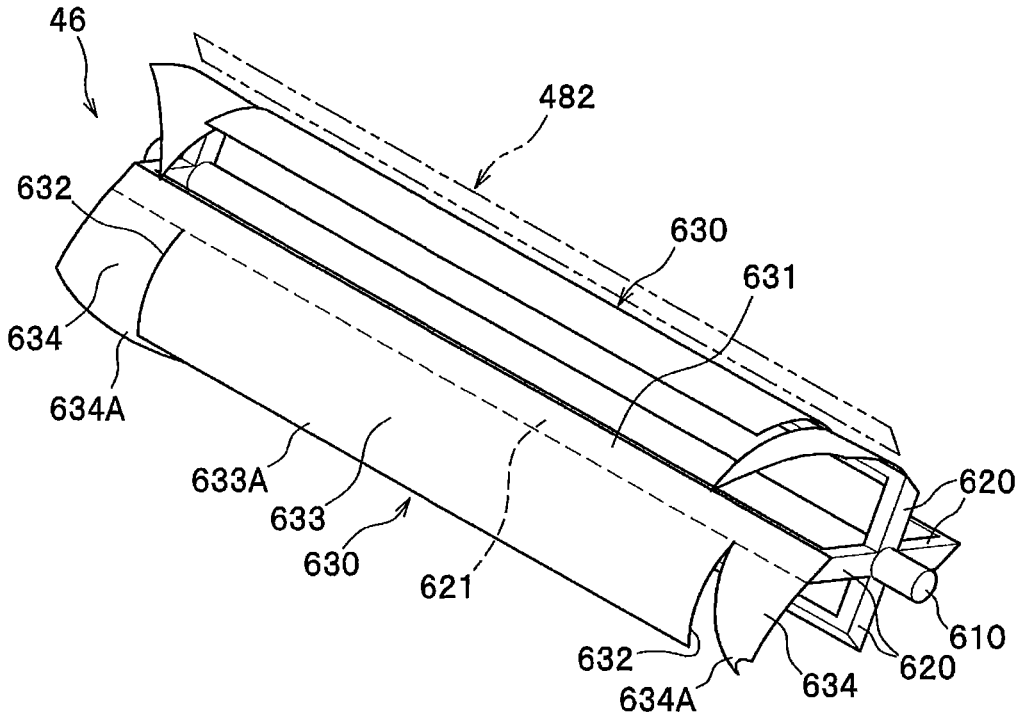
FIG. 4(*a*) is a perspective view of a toner agitator which is one of components of the developing device according to the embodiment.
Figure 4B:
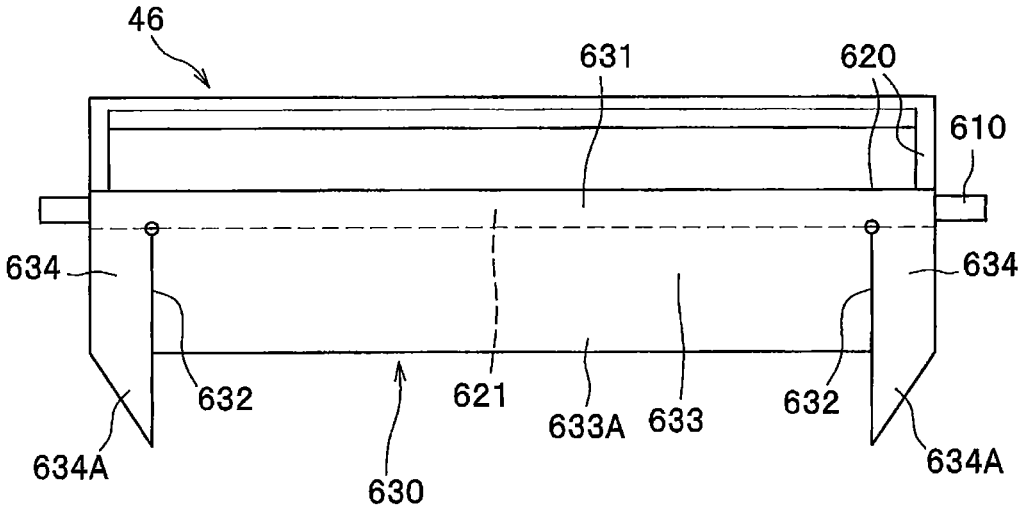
Figure 5A:
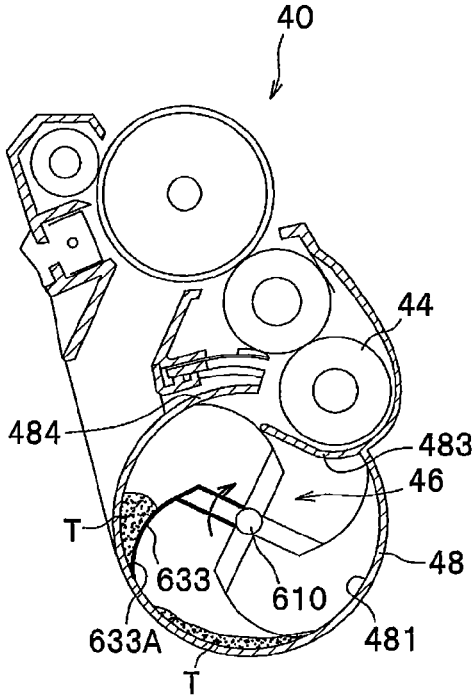
FIG. 5(*a*) through 5(*d*) are cross-sectional views for description of toner transfer in the developing device according to the embodiment.
Figure 5B:
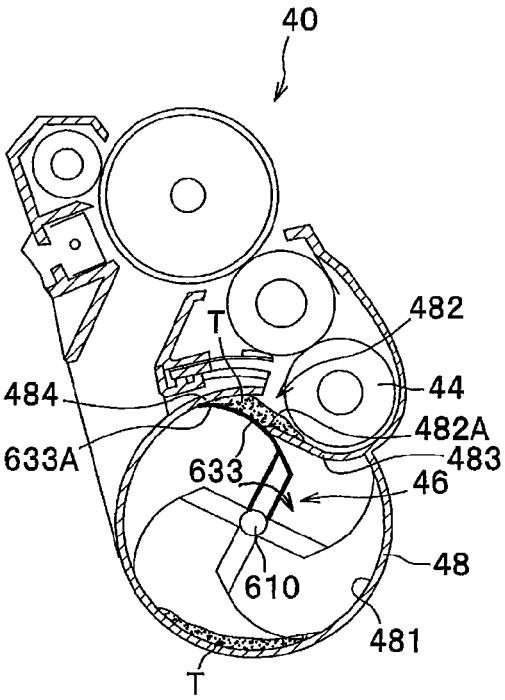
Figure 5C:
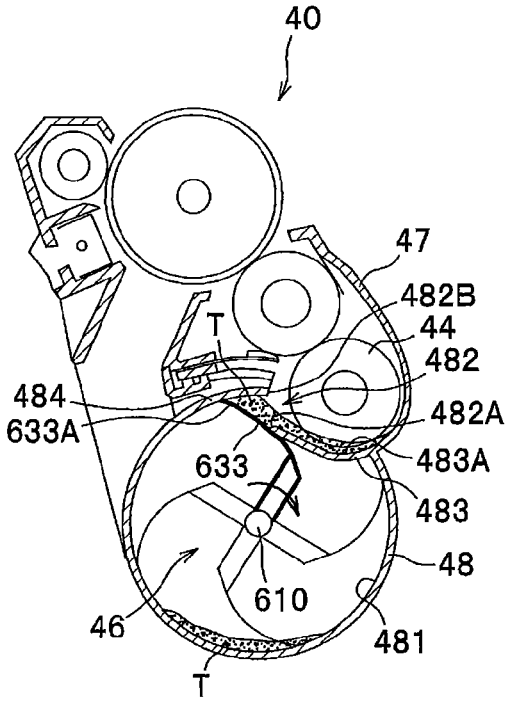
Figure 5D:
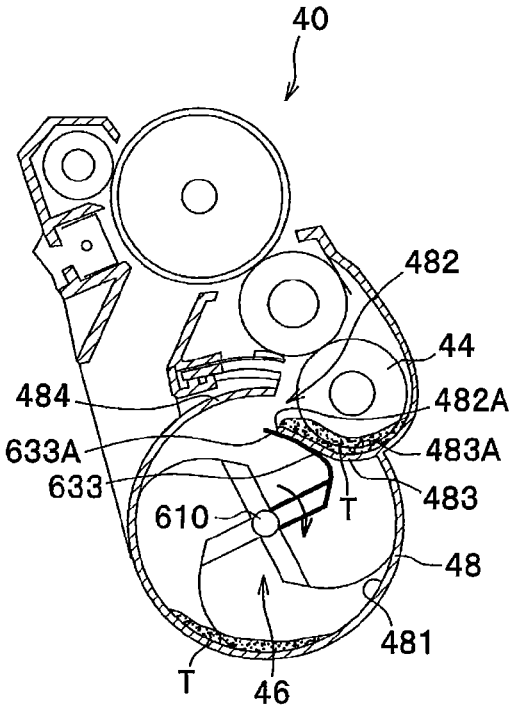
Figure 6A:
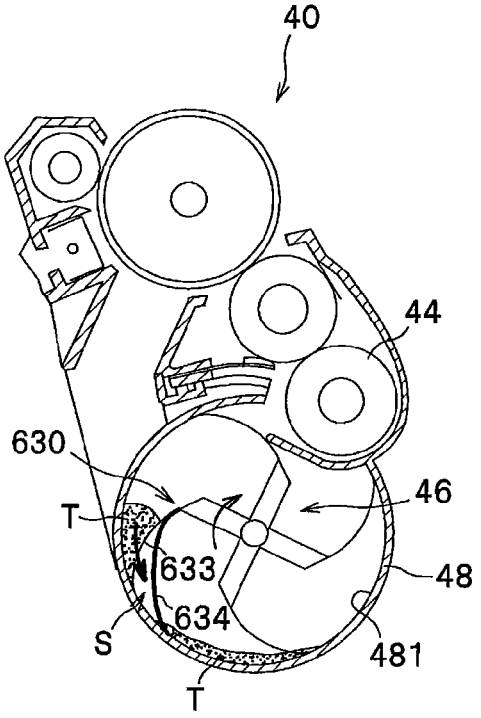
FIG. 6(*a*) through 6(*d*) are cross-sectional views for description of toner circulation between a toner chamber and a developing portion in the developing device according to the embodiment.
Figure 6B:
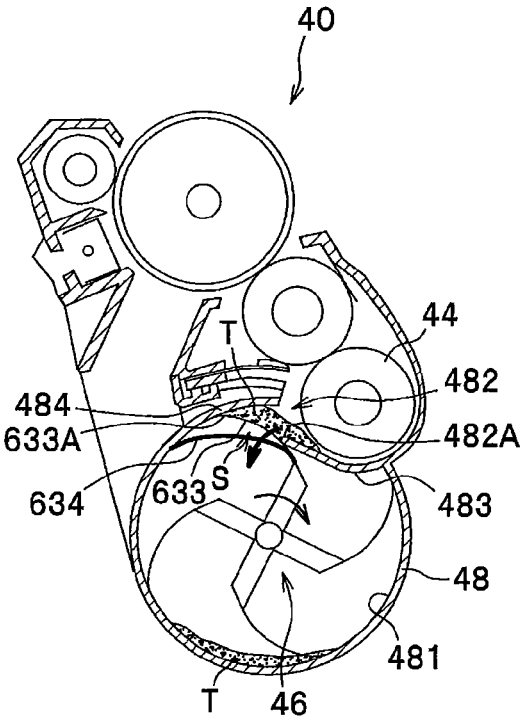
Figure 6C:
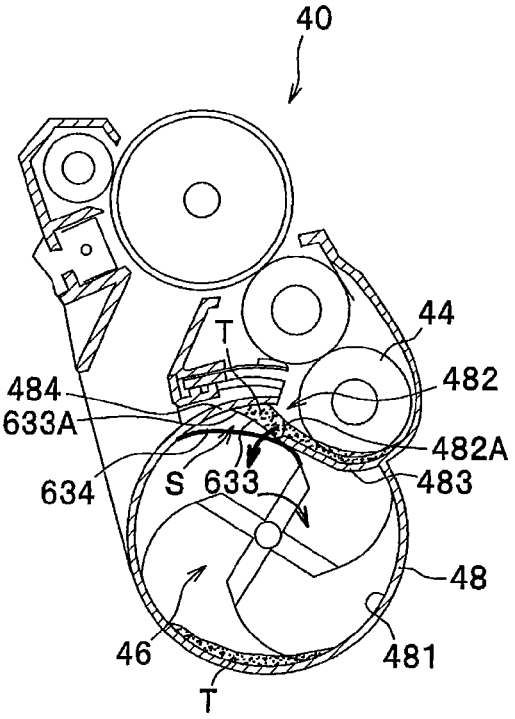
Figure 6D:
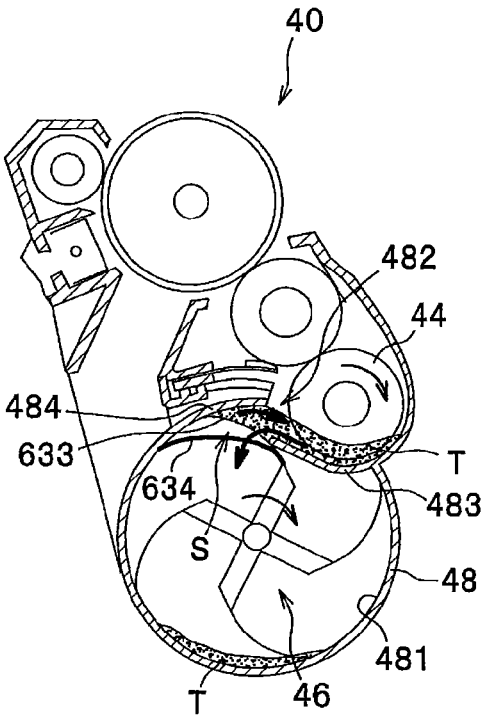

The agitator 46 is positioned in the toner container section 48. As shown in FIGS. 4(*a*) and 4(*b*), the agitator 46 includes a rotation shaft 610 extending in rightward/leftward direction (widthwise direction of the sheet P), four arms 620 extending from the rotation shaft 610 in a cruciform fashion, and agitation blades (agitation films) 630 each provided at each arm 20. For simplicity, FIG. 4(*a*) shows two agitation blades 630, and FIG. 4(*b*) shows a single agitation blade 630.

The rotation shaft 610 extends in the widthwise direction of the sheet P and is supported to a center portion of the toner container section 48. The rotation shaft 610 is rotatable in a clockwise direction in FIG. 3. More specifically, the rotation shaft 610 has one end coupled with an input gear (not shown). A motor (not shown) is provided in the casing 2. Rotation of the motor is transmitted to the input gear through a gear train (not shown) for rotating the rotation shaft 610 in a clockwise direction in FIG. 3.

Each arm 620 has a U-shaped configuration, and is integral with the rotation shaft 610 at axially end portions of the rotation shaft 610 as best shown in FIG. 4(*b*). More specifically, the arm 620 has a pair of base portions integral with the rotation shaft 620 and a spanning portion 621 spanning between free ends of the pair of base portions.

The agitation blade 630 has a base end portion 631 fixed to a radially outer side of the spanning portion 621. The agitation blade 630 extends in an axial direction of the rotation shaft 610, and is formed of a flexible sheet like member. A pair of slits 632 extends from a free end of the agitation blade 630 toward its base end, so that the agitation blade 630 is divided into three sections, i.e., a central first blade section 633 and a pair of second blade sections 634 at longitudinal end portions of the blade 630.

Figure 3:
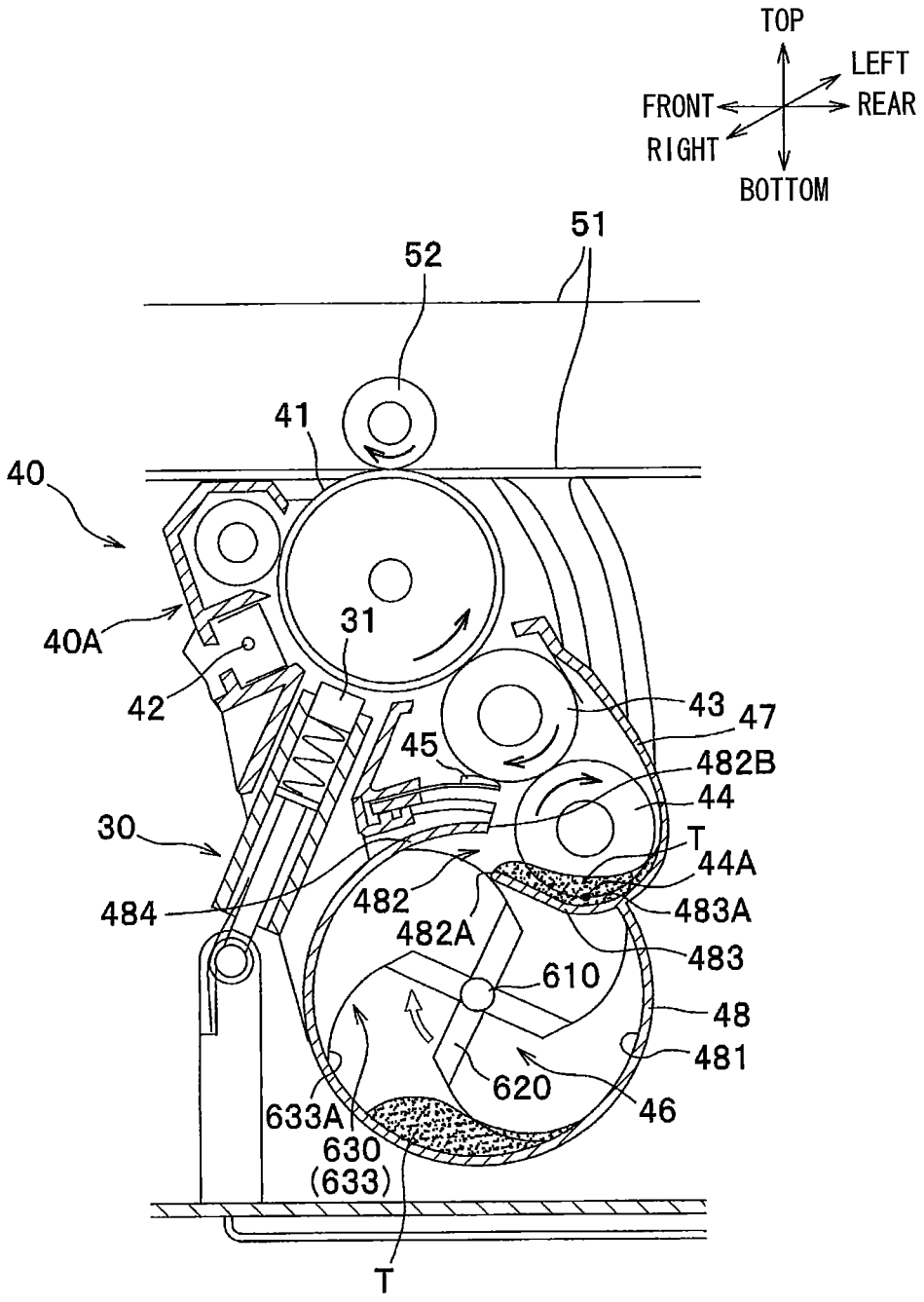
FIG. 3 is a cross-sectional view of the developing device according to the embodiment.

The first blade section 633 has generally rectangular shape and is normally flexed or arcuately deformed while a radially outer end (free end) 633A of the first blade section 633 is in sliding contact with a cylindrical inner surface 481 of the toner container section 48 as shown in FIG. 3. The second blade section 634 has a trapezoidal shape in which its free end 634A is included toward the rotation shaft 610 in a direction away from the slit 632. The second blade section 634 is normally flexed or deformed while a radially outer end (free end) 634A is in sliding contact with the inner surface 481. A length between the free end 634A of the second blade section 634 and the base end 631 is greater than a length between the free end 633A of the first blade section 633 and the base end 631.

Because of the difference in length, flexing amount of the first blade section 633 is different from that of the second blade section 634. Thus, gaps S (see FIG. 6(*a*)) are provided at each boundary between the first and second blade sections 633 and 634. Accordingly, toner leakage through the gaps S can occur.

Further, since each free end 634A of the second blade section 634 is inclined as described above, each front face of each free end portion 634A ("front" is referred in the rotational direction of the agitator) will confront with each other, i.e., the front face will be oriented toward the first blade section 622 i.e., toward longitudinally center portion of the first blade section 622 as a result of sliding contact of the free end portion 634A with the inner surface 481 of the toner container section 48. Consequently, toner deposited on a bottom surface of the toner container section 48 will be urged toward a widthwise center portion thereof. Incidentally, a width of the first and second blade sections in the axial direction of the rotation shaft 610 is determined so that an amount of the toner mainly delivered by the first blade section 633 is far greater than an amount of the toner leaked through the spaces.

The cartridge case 40A will next be described in detail. As described above, the cartridge case 40A includes the developing chamber section 47 and the toner container section 48 positioned immediately therebelow. An elongated rectangular opening 482 extending in rightward/leftward direction, i.e., a widthwise direction of the sheet P, is formed at an upper end portion of the toner container section 48 i.e., at a boundary between the developing chamber section 47 and the toner container section 48, so as to provide a fluid communication between an interior of the toner container section 48 and an interior of the developing chamber section 47. The opening 482 is positioned at upstream side of the toner supply roller 44 in the rotational direction of the agitator 46.

The toner container section 48 has an upper portion where a toner receiving wall portion 483 and a toner guide wall portion 484 are defined at a position above the agitator 46. The toner receiving wall portion 483 is adapted to receive toner delivered by the agitator 46, and the toner guide wall portion 484 is adapted for directing the toner delivered by the agitator 46 toward the toner receiving wall portion 483. The toner receiving wall portion 483 has an edge defining a lower edge 482A (first edge) of the rectangular opening 482. The toner receiving wall portion 483 obliquely extends downward from the lower edge 482A toward downstream side in the rotating direction of the agitator 46 to a position close to a bottommost portion 44A of the toner supply roller 44.

More specifically, the lower edge 482A is positioned higher than the bottommost portion 44A, and the toner receiving wall portion 483A obliquely extends rearward from the lower edge 482A to a position below the toner supply roller 44. The toner receiving wall portion 483 further extends rearward and upward along a peripheral surface of the toner supply roller 44 and becomes continuous with a rear wall of the developing chamber section 47, whereupon the toner receiving wall section 483 provides a dent or concaved toner receiving surface 483A on which toners T can be accumulated.

The toner guide wall portion 484 has an edge defining an upper edge 482B (second edge) of the rectangular opening 482. The upper edge 482B is aligned with the lower edge 482A in a vertical direction. The toner guide wall portion 484 arcuately extends downward from the upper edge 482B toward an upstream side in the rotational direction of the agitator 46, and becomes continuous with a bottom wall portion of the toner container section 48. The toner receiving wall portion 483 and the toner guide wall portion 484 provide a geometrical relationship such that the first blade section 633 can be in sliding contact with both toner receiving wall portion 483 and the toner guide wall portion 484 at a predetermined angular rotational phase of the agitator 46 (i.e., the first blade section 633 can span between the wall portions 483 and 484 at the predetermined rotational phase.

Next, operation of the developing device 40 and the color multifunction device 1 installing the developing device 40 will be described with reference to FIGS. 5(*a*) to 6(*d*). For simplicity, the following description pertains to only one of the agitation blades 630. However, the description is available for all agitation blades 630. First, toner delivery fashion will be described.

Upon rotational movement of the agitator 46 by the rotation the rotation shaft 610, the free end 633A of the first blade section 633 will be thrust into the toner T accumulated on the bottom portion of the toner container section 48. Then as shown in FIG. 5(*a*), toner T will be delivered upward while the free end portion 633A is in sliding contact with the cylindrical inner surface 481. Since no gap is provided between the free end portion 633A and the cylindrical inner surface 481 during sliding movement of the free end portion 633A, toner leakage through a space between the free end portion 633A and the inner surface 481 does not occur. Further, raking or gathering up toner T accumulated on the bottom wall portion of the toner container section 48 can be efficiently performed in spite of a small amount of toner, since the free end portion 633A is in sliding contact with the inner surface 481.

After further rotation of the agitator 46, the first blade section 633 is brought into contact with the lower edge 482A while the free end portion 633A is in contact with the toner guide wall portion 484 as shown in FIG. 5(*b*). In this state, toner T carried on the first blade section 633 cannot be dropped back to the toner container section 48, since no gap is provided between the first blade section 633 and a contour of the rectangular opening 482. Thus, mobility of the toner T on the first blade section 633 is only restricted toward the developer chamber section 48 through the rectangular opening 482.

After further rotation of the agitator 46, the first blade section 633 is brought into sliding contact with both the toner receiving wall portion 483 and the toner guide wall portion 484, i.e., the first blade section 633 is slidingly bridged therebetween as shown in FIG. 5(*c*). Therefore, toner T carried on the first blade section 633 can be delivered toward the toner receiving surface 483A through the opening 482 and is deposited on the surface 483A. Because of the simultaneous contact of the first blade section 633 with both the toner receiving wall portion 483 and the toner guide wall portion 484, efficient transportation of the toner T from lower position to an upper position can be performed.

Further, the toner container section 48 and the developing chamber section 47 are communicated with each other in a direction approximately the same as the rotational direction of the agitator 46. Therefore, toner T can be smoothly delivered onto the toner receiving surface 483A through the opening 482 in the rotational direction of the first blade section 633. Accordingly, a greater amount of toner T can be delivered to the toner receiving surface 483A.

Then, as shown in FIG. 5(*d*), sliding contact of the first blade section 633 relative to the toner receiving wall section 483 is maintained after the free end 633A is moved away from the toner guide wall portion 484. In this case, almost all toner T on the first blade section 633 is scraped by the lower edge 482A of the opening 482 and flowed toward the toner receiving surface 483A. Thus, toner T can be accumulated on the toner receiving surface 483A.

As shown in FIG. 3, the lower edge 482A is positioned higher than the bottommost portion 44A of the toner supply roller 44, and the toner receiving wall portion 483A obliquely extends rearward and downward from the lower edge 482A to the position below the toner supply roller 44 as described above. Therefore, toner T can be smoothly moved on the toner receiving surface 483A, and can be stably accumulated thereon.

Toner T accumulated on the toner receiving surface 483A will then be delivered to the outer peripheral surface of the toner supply roller 44 by the rotation of the toner supply roller 44. Since the toner receiving wall portion 483 has an arcuate configuration approximately conforming to the circular cross-sectional shape of the toner supply roller 44 for surrounding the latter, and is closely positioned immediately therebelow, the lower portion of the toner supply roller 44 can be dipped into toner T accumulated on the toner receiving surface 483A. Accordingly, toner T can be efficiently delivered to the toner supply roller 44.

Toner T delivered onto the toner supply roller 44 can then be delivered to the outer peripheral surface of the developing roller 43 to form a toner layer because of the relative sliding rotations of the toner supply roller 44 and the developing roller 43. Then, a thickness of the toner layer on the developing roller 43 is regulated by the regulation blade 45 during rotation of the developing roller 43. Thus, a toner layer having a given thickness can be formed.

Next toner circulation occurring in the cartridge case 40A will be described. As described above, the length between the free end 634A of the second blade section 634 and the base end 631 is greater than the length between the free end 633A of the first blade section 633 and the base end 631. Because of the difference in length, flexing amount of the first blade section 633 is different from that of the second blade section 634. Thus, gaps S are provided at each boundary between the first and second blade sections 633 and 634 as shown in FIG. 6(*a*).

During upward movement of the first blade section 633, excessive toner T will spill out of the first blade section 633 through the gap S. Therefore, an optimum amount of toner T can be delivered. Incidentally, since each free end 634A of the second blade section 634 is inclined as described above, each front face of each free end portion 634A can confront with each other, i.e., the front face will be oriented toward the longitudinally center portion of the first blade section 622 as a result of sliding contact of the free end portion 634A with the inner surface 481 of the toner container section 48. Accordingly, toner deposited on a bottom surface of the toner container section 48 will be urged toward a widthwise center portion thereof. Consequently, the first blade section 633 can effectively skim such toner T.

As described above, effective toner delivery onto the toner receiving surface 483A can be performed by the concurrent sliding contact of the first blade section 633 with both the toner receiving wall portion 483 and the toner guide wall portion 484. If excessive amount of toner T is delivered onto the toner receiving surface 483A, excessive toner T can be overflowed out of the toner receiving wall portion 483 and dropped into the toner container section 48 through the gap S as shown in FIGS. 6(*b*) and 6(*c*). Consequently, an optimum amount of toner T can be accumulated on the toner receiving wall portion 483.

Further, as shown in FIG. 6(*d*), toner T accumulated on the toner receiving wall portion 483 will be urged toward the opening 482 by the rotation of the toner supply roller 44 for the image forming process. Therefore, toner T can be dropped through the gap S, and a new toner T newly delivered by rotating agitator 46 can be delivered to the toner receiving wall portion 483. Thus, toner exchange can be performed with respect to toner T on the toner receiving wall portion 483. That is, circulation of toner T can be performed between the toner container section 48 and the toner receiving wall portion 483.

Generally, electrically charging characteristic of toner T may be inevitably degraded due to friction between toner particles or between toner and the toner supply roller. Toner T on the toner receiving wall portion 483 provides relatively high density and is in frictional contact with the toner supply roller 44. Therefore, toner T on the toner receiving wall portion 483 is subjected to degradation easier than that of the toner in the toner container section 48. In this connection, toner circulation between the toner receiving wall portion 483 and the toner container section 48 can restrain stagnation of toner on the toner receiving wall portion 483. Thus, prolonged service life of the toner T can result, i.e., the developing device 40 can provide a prolonged service life.

Next, image forming operation in the color multifunction device 1 will be described. Upon start of the image forming operation, each surface of each photosensitive drum 41 is uniformly charged by each charger 42, and is exposed to light by each LED head 31 of each LED unit 30. Therefore, potential at the exposed region becomes lowered to provide an electrostatic latent image corresponding to image data can be formed on each photosensitive drum 41.

Upon rotation of the developing roller 43, toner carried on the developing roller 37 will be supplied to the electrostatic latent image area on the photosensitive drum 41 when the toner is brought into contact with the photosensitive drum 41, where-upon a visible toner image corresponding to the electrostatic latent image is formed on the surface of the photosensitive drum 41.

Then, the toner images on the photosensitive drum will be transferred onto the intermediate transfer belt 51 by transfer bias applied to each primary transfer roller 52. Therefore, toner images of different colors are superposedly transferred onto the intermediate transfer belt 51. Then, the toner image on the intermediate transfer belt 51 will be transferred to the sheet P supplied from the sheet supply mechanism 4, when the sheet P passes between the intermediate transfer belt 51 and the secondary transfer roller 53 by the transfer bias applied to the secondary transfer roller 53.

The sheet P carrying the color toner image is then delivered to the fixing unit 60. When the sheet P is nipped between the heat roller 61 and the pressure roller 62 the color toner image is thermally fixed to the sheet P. Then, the sheet P is conveyed out of the casing 2 and discharged onto the discharge tray 2B by the discharge roller 6.

Figure 7:
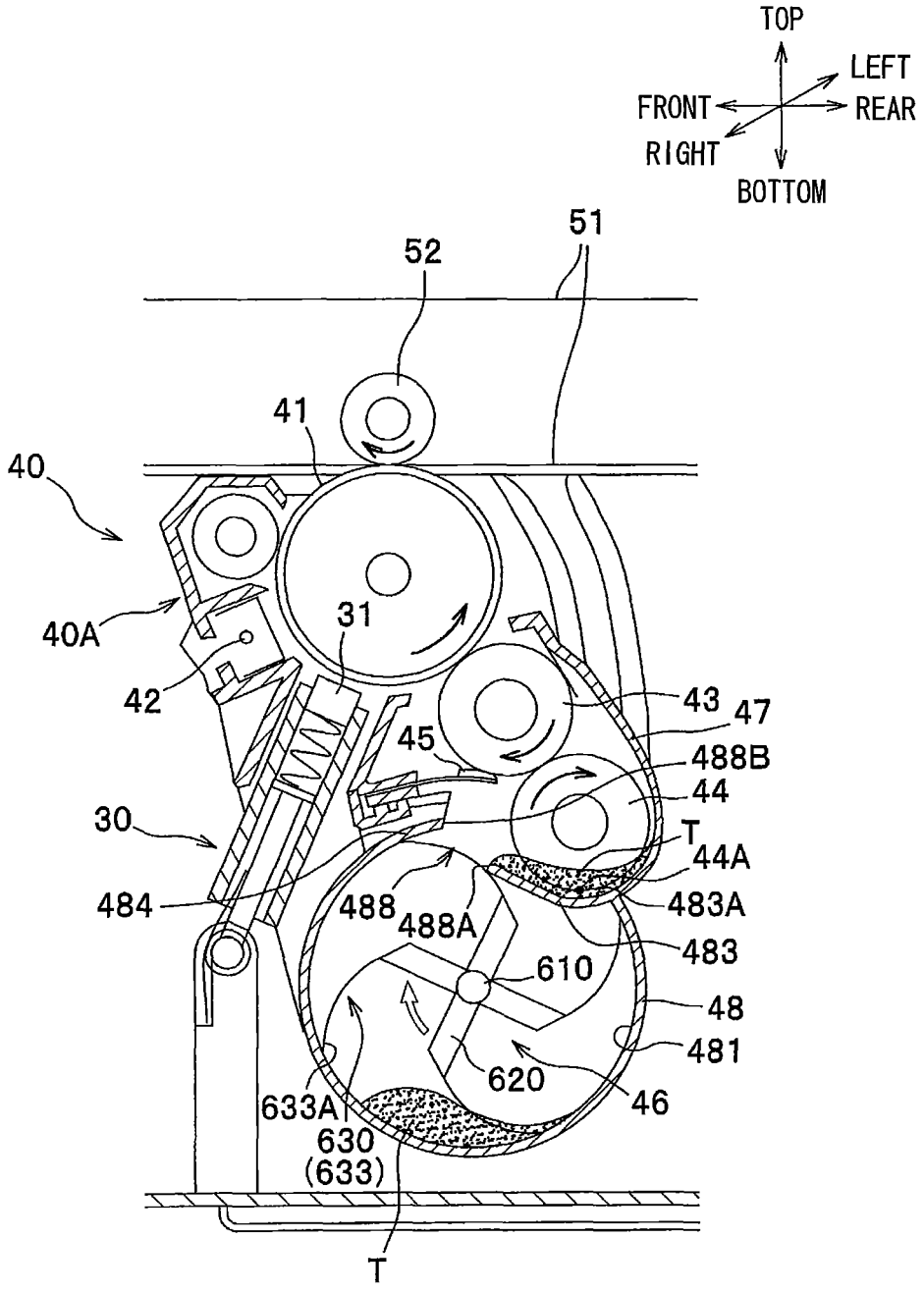
FIG. 7 is a cross-sectional view of a developing device according to a first modification to the embodiment; and, FIG. 8 is a cross-sectional view of a developing device according to a second modification to the embodiment.

A first modification to the above described embodiment is shown in FIG. 7. In the above-described embodiment, the lower edge 482A and the upper edge 482B of the opening 482 are aligned in vertical direction. In contrast according to the first modification, an upper edge 488B of an opening 488 is positioned upstream of a lower edge 488A of the opening 488 in the rotational direction of the agitator 46. With this arrangement, the flexed first blade section 633 can promptly restore its linearity when its free end portion 633A is separated from the upper edge 488B. Consequently, toner T on the first blade section 633 can be vigorously moved toward the developing chamber section 47.

Figure 8:
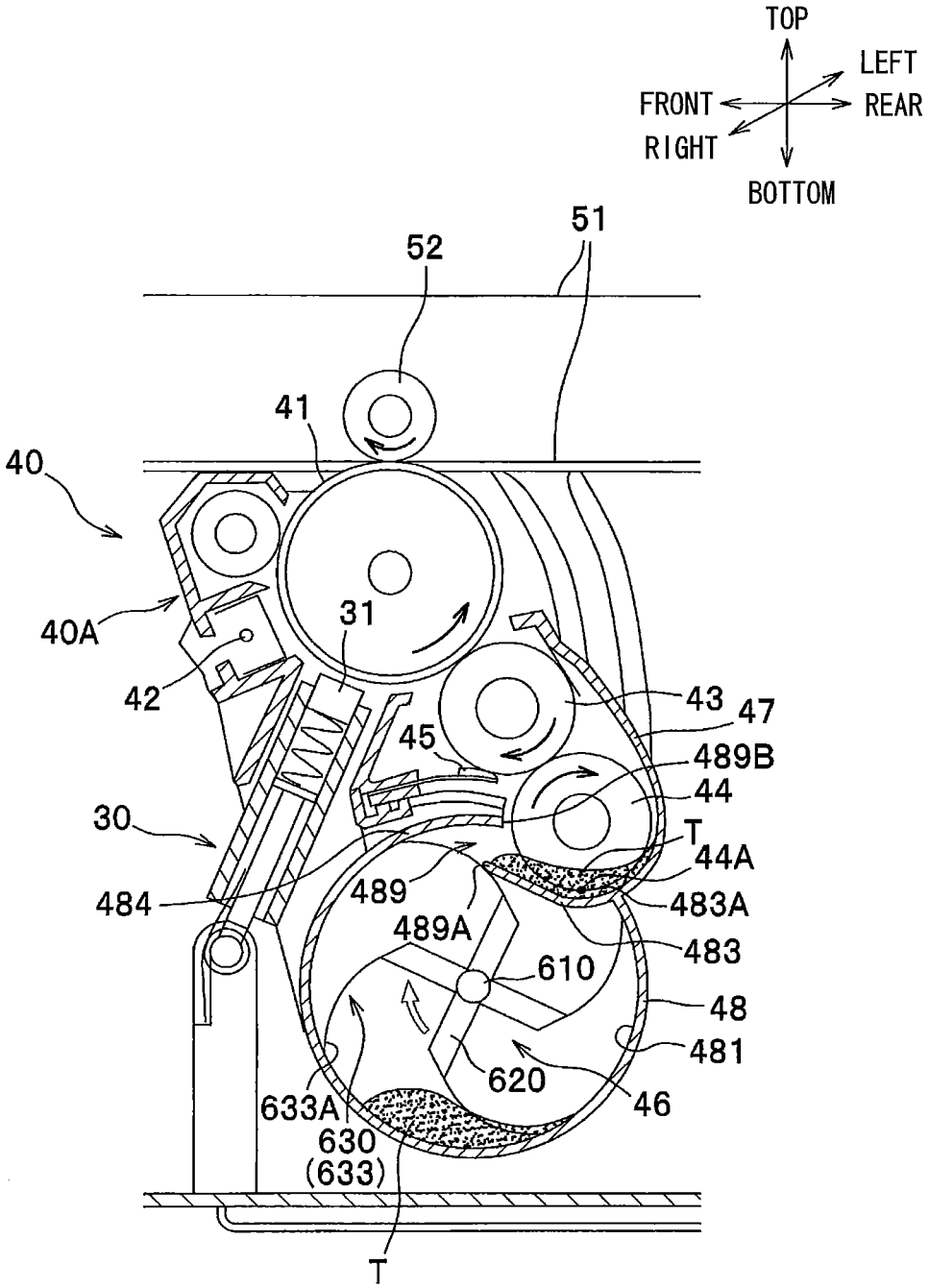

A second modification to the above described embodiment is shown in FIG. 8. In the second modification, an upper edge 489B of an opening 489 is positioned downstream of a lower edge 489A of the opening 489 in the rotational direction of the agitator 46. Since the toner guide wall portion 484 largely extends into the developing chamber section 47, toner T can be directed toward the toner supply roller 44 without being moved upward. Consequently, greater amount of toner T can be supplied onto the toner receiving wall portion 483 and to the toner supply roller 44.

Further, various modifications are conceivable with respect to the agitator as long as the agitation blade can deliver the toner in the toner container section 48 upward. For example, in the above-described embodiment, the agitator 46 includes four agitation blades 630. However, a single agitation blade is available. Further, blade(s) can be directly fixed to the rotation shaft 610 without the arm 620. Further, in the above-described embodiment, the agitation blade is split into first and second blade sections 633, 634. However, non-split type blade section is available.

Further, in the above-described embodiment, the lower edge 482A of the opening 482 is positioned higher than the bottommost portion 44A of the toner supply roller 44, and the toner receiving wall portion 483 is directed obliquely downward from the lower edge 482A toward the portion below the toner supply roller 44. However, a toner receiving wall portion can extend generally horizontally from the lower edge in a downstream direction in the rotating direction of the agitator to a position close to the bottommost portion of the toner supply roller 44.

Further, in the above-described embodiment, the cartridge case 40A is an integral component including the toner container section 48 as a part of the cartridge case 40A. However, a developer chamber casing accommodating therein the developing roller 43 and the toner supply roller 44 can be provided separately from a toner container.

Further, in the above-described embodiment, the photosensitive drum 41 is accommodated in the developing device 40A. However, a developing device eliminating the photosensitive drum is also available.

Further, the toner delivery mechanism for conveying toner from the agitator 46 to the photosensitive drum 41 is not limited to the above-described developing roller 43 and the toner supply roller 44, but various modifications are available. Further, arrangement of the rollers in the developing device 40 is not limited to the above-described embodiment. For example, upper and lower toner supply rollers can be used, the upper roller being in contact with the developing roller, and the lower roller being in contact with the upper roller and in contact with toner T accumulated on the toner receiving wall portion.

Further, the above-described embodiment pertains to the color multifunction device 1 where the intermediate transfer belt 51 is provided above the developing devices 40. However, other type of image forming device is available. For example, a sheet conveyer belt can be provided instead of the intermediate transfer belt. Furthermore, a copying machine and a printer without provision of the flat bed scanner 3 are also available. Moreover, a printer, a copying machine and a multifunction device, those having exposure system with a laser beam are also available.

While the invention has been described in detail with reference to the embodiments thereof, it would be apparent to those skilled in the art that various changes and modifications may be made therein without departing from the spirit of the invention.

What is claimed is:

1. An image forming device comprising:

a casing;

a support frame configured to be drawn from the casing; and a plurality of cartridges configured to be detachably supported by the support frame, each of the cartridges comprising:

a developing member having an outer surface configured to carry a developing agent;

a supply member configured to supply the developing agent to the outer surface;

a conveying member rotatably disposed in an internal space and configured to convey the developing agent upward;

a developing agent container disposed below the developing member and the supply member and having an inner surface defining the internal space for accommodating the developing agent, the developing agent container being formed with a single opening having an upper edge and a lower edge, and the developing agent container including a first wall portion extending from the lower edge in a downstream direction with respect to a rotational direction of the conveying member and a second wall portion extending from the upper edge in an upstream direction with respect to the rotational direction; and a regulation blade configured to regulate a thickness of a layer of the developing agent on the outer surface of the developing member, and positioned above the second wall portion, the regulation blade having a free end portion contacting the developing agent at a position above the single opening, wherein the conveying member is configured to be in simultaneous sliding contact with both the lower edge and the upper edge to convey the developing agent onto the first wall portion.

2. The image forming device as claimed in claim 1, wherein the supply member is positioned below the developing member.

3. The image forming device as claimed in claim 1, wherein the conveying member is configured to be in rotational contact with the inner surface.

4. The image forming device as claimed in claim 1, wherein the supply member is configured to be rotated in a direction the same as the rotational direction of the conveying member.

5. The image forming device as claimed in claim 1, wherein the conveying member is in simultaneous sliding contact with the first wall portion and the second wall portion for conveying the developing agent upon the first wall portion.

6. The image forming device as claimed in claim 1, wherein the first wall portion obliquely extends downward from the lower edge toward a position immediately below the supply member.

7. The image forming device as claimed in claim 1, wherein the upper edge is positioned upstream of the lower edge in the rotational direction.

8. The image forming device as claimed in claim 1, wherein the upper edge is positioned downstream of the lower edge in the rotational direction.

* * * * *